US006308623B1

(12) United States Patent
Schönberger et al.

(10) Patent No.: US 6,308,623 B1
(45) Date of Patent: Oct. 30, 2001

(54) METERABLE SCREEN ROLLER IN A ROTARY PRINTING MACHINE

(75) Inventors: Wolfgang Schönberger, Schriesheim; Rolf Spilger, Viernheim, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/483,736

(22) Filed: Jan. 14, 2000

(30) Foreign Application Priority Data

Jan. 14, 1999 (DE) ..... 199 01 243

(51) Int. Cl.[7] ..... B41F 31/26

(52) U.S. Cl. ..... 101/352.13; 101/153; 101/478; 492/30

(58) Field of Search ..... 101/150, 153, 101/170, 348, 349.1, 352.11, 352.13, 401.1, 478; 492/30–32, 35; 29/895.23, 895.32

(56) References Cited

U.S. PATENT DOCUMENTS 4,195,570 * 4/1980 Haren ..... 101/348
4,407,196 * 10/1983 Matalia et al. ..... 101/148
4,805,530 * 2/1989 Kobler et al. ..... 101/350
5,233,921 * 8/1993 John ..... 101/349
5,778,775 * 7/1998 Schafer ..... 101/141
5,786,051 * 7/1998 Niggemeier et al. ..... 492/31
5,813,961 * 9/1998 Buchwald ..... 101/348
6,006,665 * 12/1999 Stuchlik et al. ..... 101/352.13

FOREIGN PATENT DOCUMENTS 38 06 466 C2 9/1989 (DE) .
39 38 449 C2 5/1991 (DE) .
44 08 615 A1 9/1995 (DE) .

* cited by examiner

*Primary Examiner*—Stephen R. Funk
(74) *Attorney, Agent, or Firm*—Herbert L. Lerner; Laurence A. Greenberg; Werner H. Stemer

(57) ABSTRACT

A meterable screen roller having a peripheral surface whereon a multiplicity of printing ink-accepting depressions are disposed includes a respective base for the depressions formed by a resilient material, and respective chambers located underneath and assigned to the depressions, the chambers being actable upon by a pressure medium for respectively enlarging and reducing the volume of the depressions.

13 Claims, 3 Drawing Sheets

METERABLE SCREEN ROLLER IN A ROTARY PRINTING MACHINE

BACKGROUND OF THE INVENTION

Field of the Invention

The invention relates to a meterable screen or halftone roller, especially for an anilox inking unit in a rotary printing machine, with a multiplicity of printing ink-accepting depressions disposed on the peripheral surface of the screen or halftone roller.

In the arts of gravure printing and offset printing, inking units are provided wherein printing ink is introduced via a doctor chamber into dimples or groove-like depressions formed in a screen or halftone roller, for example, an anilox roller, which subsequently transfers the printing ink, generally via one or more intermediate rollers, to the surface of a printing-form cylinder.

Screen rollers having depressions formed in the surface thereof by engraving, etching or with the aid of lasers have become known heretofore, the rollers being made, for example, of steel, chromium, copper and/or ceramic. A factor that is common to all the screen rollers is that they have dimples or groove-like depressions, the volume of which is defined during the production of the roller and, except for wear caused by the doctoring operation, can generally no longer be altered thereafter.

Because the quantity of ink transferred to the printing form or plate is determined by the volume of the dimples or the groove-like depressions formed in the screen or halftone rollers, and the quantity of ink required overall depends upon the size of the area of the printing form or plate that is to be inked, it is desirable to be able to alter the quantity of ink from the viewpoint of an optimum adaptation or matching of the quantity of ink supplied to the respective print job.

In this connection, in the case of rollers made of ceramic partly filled with copper, it has become known heretofore to remove copper from the filler by etching the roller, in order thereby to increase the volume of the dimples or grooves. In the case of these rollers, however, a reduction in volume can be produced only by grinding over the latter, however, this entails a comparatively great mechanical effort and, in addition, results in a reduction in the circumference of the roller, that has a detrimental effect upon the printing process.

It has furthermore become known from German Patent 44 08 615 to introduce into the dimples or depressions of a screen or halftone roller a piezoelectric material that expands or contracts when an electrical voltage is applied and, consequently, produces an alteration in the volume of the dimples or depressions. A disadvantage with respect to the aforedescribed screen or halftone roller is that, in order to effect an alteration in the volume of the dimples or depressions that is visible in the printed image, the piezoelectric material in each of the dimples or depressions has to have a very high voltage applied thereto, which results not only in the occurrence of technical problems during the production of the screen or halftone roller, but also, because of the risk of voltage flashovers, constitutes a considerable safety risk during the operation of the roller.

SUMMARY OF THE INVENTION

It is accordingly an object of the invention to provide a meterable screen or halftone roller, especially for an anilox inking unit of a rotary printing machine, which has a simple construction, is cost-effective to produce and with which an effective and specific alteration of the quantity of ink transferred by the roller is possible.

With the foregoing and other objects in view, there is provided, in accordance with the invention, a meterable screen roller having a peripheral surface whereon a multiplicity of printing ink-accepting depressions are disposed, comprising a respective base for the depressions formed by a resilient material, and respective chambers located underneath and assigned to the depressions, the chambers being actable upon by a pressure medium for respectively enlarging and reducing the volume of the depressions.

In accordance with another feature of the invention, the screen roller includes a structured tube having an outer circumferential surface whereon the depressions are permanently formed, and having an inner circumferential surface formed with webs disposed between the depressions, the chambers being defined by the webs.

In accordance with a further feature of the invention, the screen roller includes a rotatably mounted roller core onto which the structured tube is slidable.

In accordance with an added feature of the invention, the screen roller includes a roller base member having a circumferential surface formed with recesses which are configured so as to accord with the shape of the depressions, said recesses being covered by a flexible covering so as to form said chambers, and feed ducts for applying pressure medium to the recesses.

In accordance with an additional feature of the invention, the recesses are formed as a spirally revolving groove.

In accordance with yet another feature of the invention, the recesses are formed by grooves extending in axial direction over the circumferential surface of the roller base member.

In accordance with yet a further feature of the invention, the roller base member, in the region of the outer circumferential surface thereof, is made of porous material connected to the pressure-medium feed ducts and formed with the recesses.

In accordance with yet an added feature of the invention, the roller base member includes a rotatably mounted core and a jacket member made of the porous material disposed thereon, the recesses being formed directly in the jacket member.

In accordance with yet an additional feature of the invention, the flexible covering is formed by a sleeve slidable axially onto the roller base member.

In accordance with still another feature of the invention, the depressions are formed in the sleeve as a permanently predefined structure.

In accordance still a further feature of the invention, the pressure medium is a liquid.

In accordance with an alternative feature of the invention, the pressure medium is a gas actable from the outside upon the circumferential surface of the screen roller, a respective increase and decrease in the gas pressure serving for the enlargement and reduction of the volume of the depressions.

In accordance with a concomitant feature of the invention, the screen roller is for an anilox inking unit in a rotary printing machine.

Thus, the meterable screen or halftone roller according to the invention is distinguished by the fact that the base of the depressions, i.e., the dimples or grooves, is formed by a resilient material, underneath which chambers are formed which are assigned to the depressions and to which a pressure medium, for example, compressed air or a liquid, can be applied for the purpose of enlarging or reducing the volume of the depressions. This provides the advantage that, by increasing or decreasing the pressure of the pressure medium, when all the chambers are acted upon cumulatively, the total quantity of ink conveyed by the screen roller can be altered in a relatively simple manner without incurring the risk, for example, of voltage flashovers or other secondary effects which disrupt the printing process. Provision can be made in a similar manner, however, for the chambers underneath the depressions to be connected in groups via appropriate feed ducts, to which a different pressure can be applied, independently of one another, via respectively associated valves. Thereby, if desired, an ability to alter the quantity of supplied ink in a relatively simple and reliable zonal manner is provided, such as is otherwise known only from blade inking units which are equipped with separately adjustable inking zone screws.

The provision of a structured tube having an outer circumferential surface wherein the depressions are formed, for example by etching or laser machining or in any other conventional manner, and an inner circumferential surface, arranged between the depressions, whereon webs are formed which laterally bound or define the chambers to which the pressure medium can be applied, results in the advantage that the roller can be produced comparatively cost-effectively, either directly by welding shaft journals onto the tube or, in the event that a rotatably mounted cylindrical roller core is provided, by simply pushing or sliding the structured tube onto the roller core.

According to a further embodiment of the screen roller according to the invention, the latter comprises a roller base member, having a circumferential surface wherein recesses are formed which are configured to accord with the shape of the dimples or depressions and to which the pressure medium can be applied via feed ducts in the interior of the roller base member. In order to produce the dimple-like or groove-like depressions, the roller base member constructed in the aforementioned manner is subsequently covered by a flexible covering which, for example, has the form of a plate or preferably a flexible sleeve that can be pushed or slid onto the base member, and further defining or bounding the chambers located underneath the depressions. This results in a screen or halftone roller that is very simple to produce, and that additionally also has a virtually wear-free roller base member, because the flexible covering as a single wearing part can be changed in a very short time if the printing quality decreases. In this case, the feed ducts for the pressure medium to the chambers, or the chambers themselves, can be formed as an individual groove running spirally or, if desired, as a large number of grooves running in the axial direction over the circumferential surface of the roller base member. Because the grooves can be introduced very simply and with very high accuracy by milling, etching or with the aid of a laser into the preferably ground and smooth circumferential surface of the roller base member, the production of the roller base member is only slightly more complicated than the production of a conventional sleeve or halftone roller with a permanently predefined dimple or depression volume.

According to a further embodiment of the invention, in the region of the outer circumferential surface of the roller base member, the latter is formed of porous material that is connected to the feed ducts for the pressure medium, the recesses being formed directly in the porous material. The feed ducts can, for example, likewise be formed directly in the porous material.

According to an embodiment that is particularly advantageous to produce, the porous material can moreover be formed as a covering element that can be pushed or slid in the axial direction onto a rotatably mounted core of the roller base member. In this case, the feed ducts are preferably configured as a groove formed in the circumferential surface of the rotatably mounted core of the roller base member and covered on the outside by the inner circumferential surface of the covering element, by which the outlay for production can again be reduced further.

In the case of the embodiment described hereinbefore, the flexible covering is preferably formed by a sleeve that can be pushed or slid axially onto the roller base member. The expansion of the sleeve is advantageously achieved in this case by feeding compressed air through the feed ducts into the chambers underneath the depressions, as a result of which the diameter of the sleeve is expanded and the latter can be pushed or slid onto the roller base member on an air cushion. After the compressed air has been switched off and a vacuum has been applied via the feed ducts, the flexible covering on the roller base member is reliably installed during the operation of the roller in order to be able to remove it again without difficulty in an opposite procedure by once again applying compressed air to the feed ducts in the event of the occurrence of wear phenomena.

Furthermore, provision can be made for the depressions in the flexible covering to be formed as a permanently predefined structure, which results in the advantage that the fundamental depth of the dimples, and the volume of the dimples in different regions of the screen or halftone roller can have different values, even when a uniform vacuum is applied to all the dimples, and adaptation or matching of the screen or halftone roller to different print jobs can be performed in an advantageous manner by simply replacing the flexible covering.

The pressure medium can be, for example, a gas, preferably air, the desired alteration to the volume being produced by an appropriate increase or decrease in the air pressure. Furthermore, it is also possible, however, to select a liquid as pressure medium, which results in the advantage that, because of the incompressibility of liquids and the comparatively low temperature-induced change in volume thereof, a very constant dimple or groove volume results, which changes only insignificantly in the event of high contact pressure of the rollers on other rollers or in the event of severe temperature fluctuations. Furthermore, there results an advantage that considerably greater pressures can be produced due to the use of liquids, which can be provided to alter the volume of the depressions.

Other features which are considered as characteristic for the invention are set forth in the appended claims.

Although the invention is illustrated and described herein as embodied in a meterable screen or halftone roller in a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
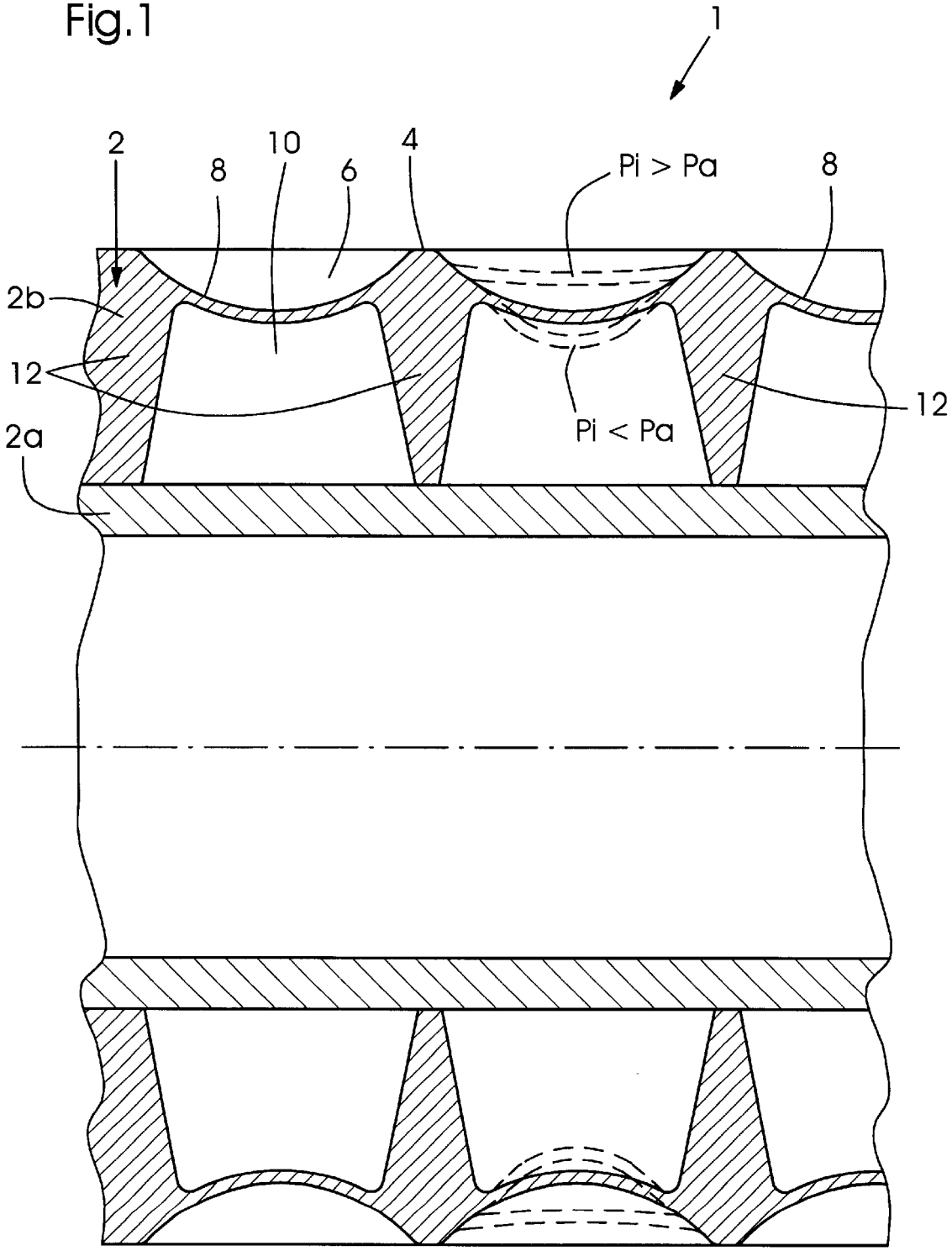
FIG. 1 is a fragmentary diagrammatic longitudinal sectional view of a screen or halftone roller according to the invention, wherein depressions are formed permanently in a structured tube and, between and underneath the depressions, webs are disposed which define chambers fillable with pressure medium.

Referring now to the drawings and, first, particularly to FIG. 1 thereof, there is shown therein a screen or halftone roller 1 according to the invention including a roller base member 2 in the form of a structured tube 2*b,* having an outer circumferential surface 4 wherein depressions 6 for receiving printing ink therein have been permanently formed. The structured tube 2*b* may be formed, for example, so as to be slidable axially onto a rotatably mounted roller core 2*a*. The depressions 6 have respective bases 8 formed, in this case, by a thin wall below which there is arranged a chamber 10 fillable with a pressure medium and being bounded or defined by webs 12 arranged between and underneath the depressions 6. By introducing a positive pressure or a negative pressure within the chambers 10 arranged underneath each depression 6 in the roller 1, the base 8 of the depressions 6 can be altered in the manner indicated by the broken lines in FIG. 1, due to the resilience of the material forming the base 8.

By applying a negative pressure to the chambers 10, the base 8 is expanded to the position identified by the broken lines at Pi<Pa, and hence an enlargement of the volume of the depressions 6 results, whereas, when a positive pressure is applied to the chambers 10, the base 8 is contracted to the position identified by the broken lines at Pi>Pa, which corresponds to a reduction in the volume of the respective depression 6.

Figure 2:
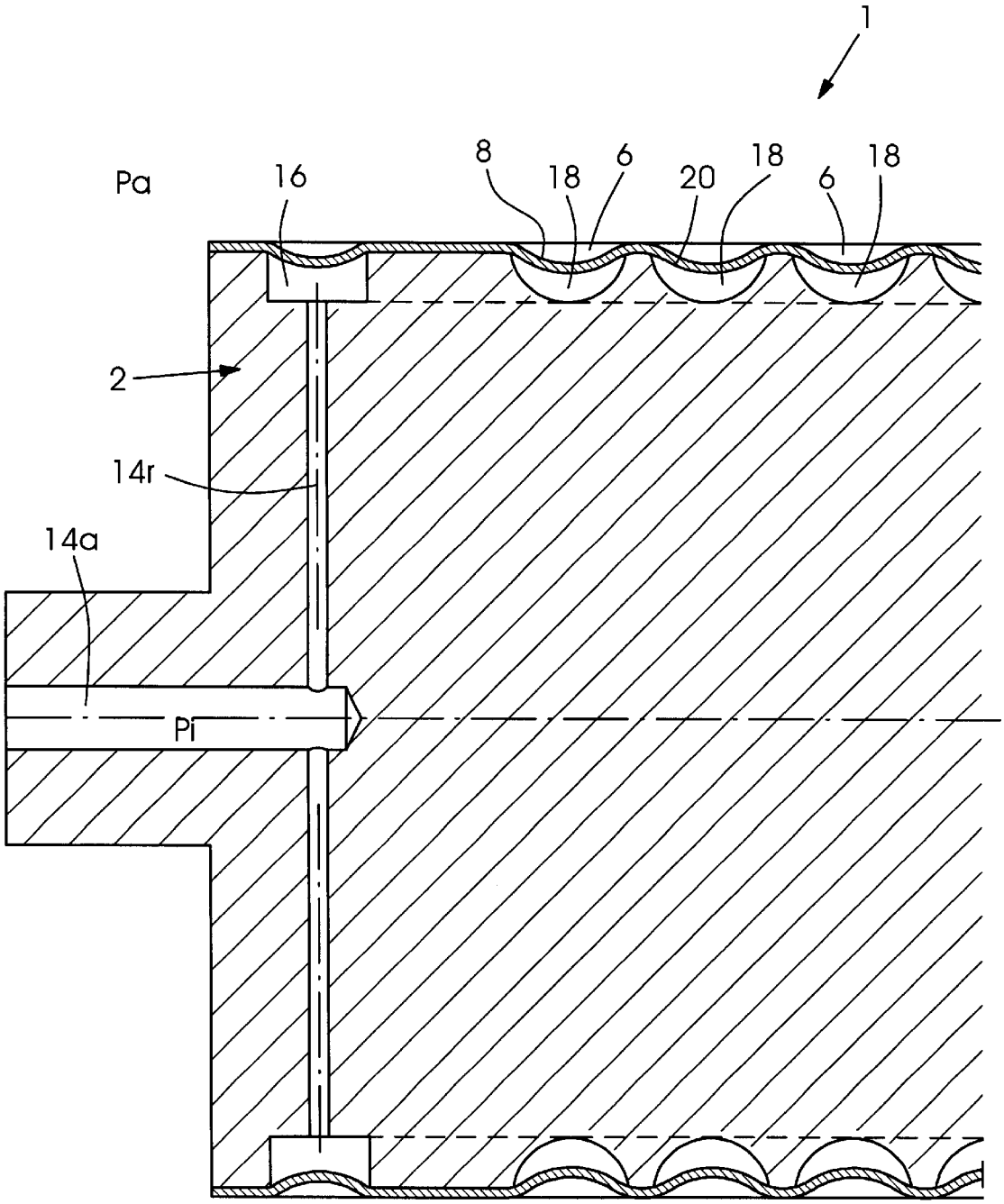
FIG. 2 is a fragmentary diagrammatic longitudinal sectional view of a different and preferred embodiment of the screen or halftone roller according to the invention, wherein the depressions receiving the printing ink are formed by a flexible covering applied to a roller base member, and chambers located underneath the flexible covering are formed by recesses provided directly in the outer circumferential surface of the roller base member.

In the embodiment of a screen or halftone roller 1 according to the invention illustrated in FIG. 2, which proves to be particularly advantageous from the point of view of the manufacturing process and wear behavior, the roller base member 2 is formed of solid material, for example, of aluminum or steel, wherein preferably axial and radial feed ducts 14*a* and 14*r,* respectively, have been provided. The radial feed ducts 14*r* terminate in a pressure distribution chamber 16, which has a flow connection to the recesses 18 formed in the circumferential surface of the roller base member 2. The recesses 18 can be formed, for example, as a spirally revolving groove, or can have the form of dimples. In addition, the dimples can be connected to the pressure distribution chamber 16, for example, by feed bores extending through the roller base member 2 in axial direction, but not illustrated in FIG. 2.

A covering 20 of a flexible material, for example, rubber, plastic material or a thin-walled metal, is applied to the roller base member 2 formed in the aforedescribed manner. The covering 20 is preferably formed as a sleeve which, by applying compressed air to the feed bore 14*a,* can be pushed or slid axially on an air cushion onto the roller base member 2, and held and secured in position thereon after the compressed air has been switched off and/or a vacuum has been applied. In this case, provision can be made for the sleeve to have a predefined structure, by which the basic volume of the depressions 6 as a whole, and in different regions of the circumferential surface of the roller 1, can be adapted or matched to the respective requirements. Thus, for example, in non-printing areas, that is to say in areas wherein no printing ink is to be transferred by the screen or halftone roller 1, it is possible for a structure to be used that has convex bulges formed above the depressions 6, and, after a vacuum has been applied to the feed bore 14*a* and the recesses 18, respectively, the structure is deformed to a substantially flat or planar region.

Figure 3:
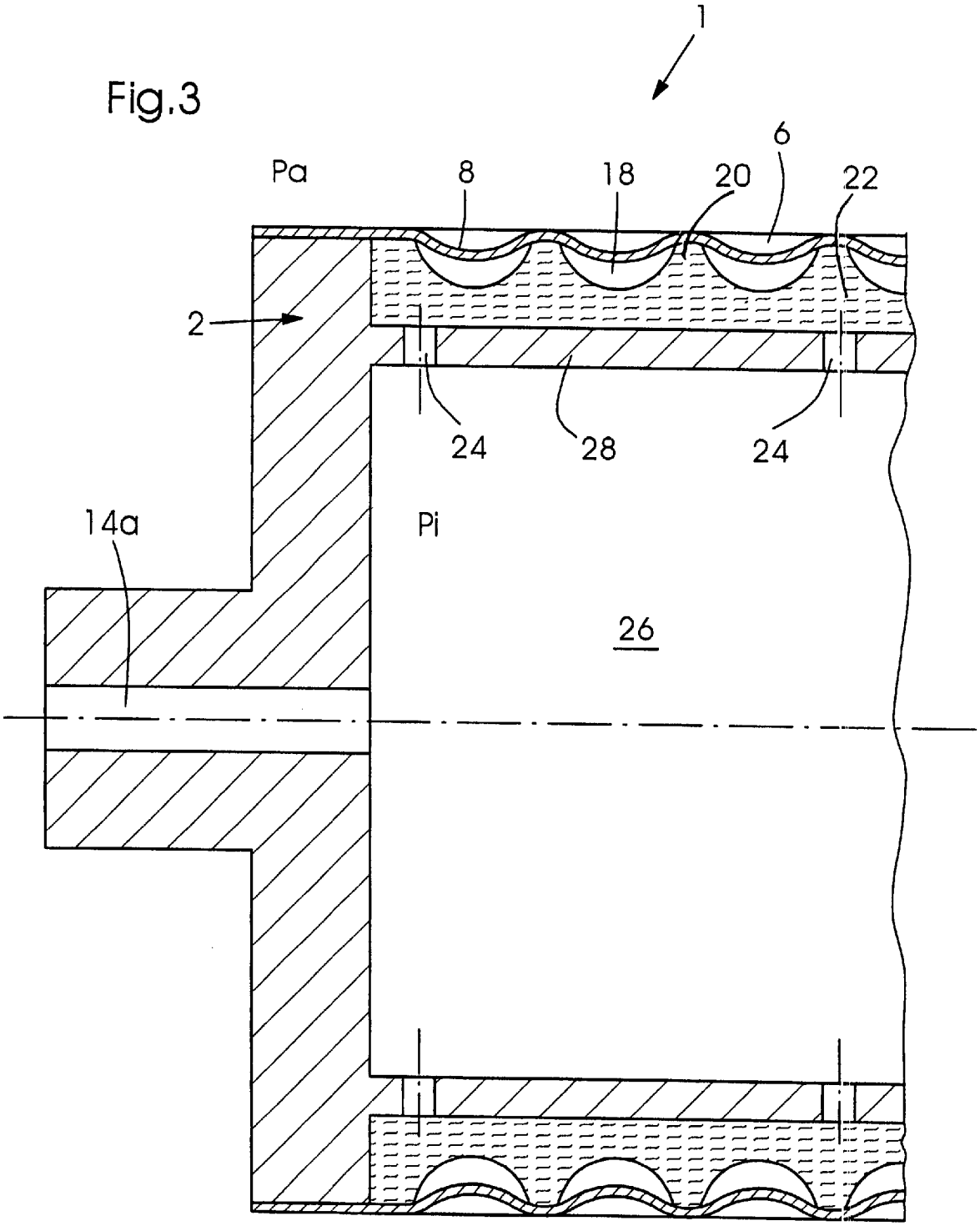
FIG. 3 is a fragmentary diagrammatic longitudinal sectional view of yet another different embodiment of the screen or halftone roller according to the invention, wherein recesses are provided in a jacket member formed of porous material and connected to feed bores for pressure medium in the interior of the roller base member, the jacket member being covered on the outside thereof by a flexible covering.

Furthermore, it is possible, according to the embodiment of the invention shown in FIG. 3, to form the recesses 18 in a jacket member 22 made of solid and porous material, the pressure medium being applied to the jacket member 22 via radial feed bores 24. In this case, the radial feed bores 24 can be connected, for example, to a cavity 26 formed in the interior of the roller base member 2, the pressure medium being applied to the cavity 26 via the axial feed bore 14*a*. The jacket member 22 formed of porous material is preferably pushed or slid axially onto a cylindrical, smooth-walled core 28 of the cylinder or roller base member 2, which is rotatably mounted in the inking unit of the printing machine.

Finally, there is a possibility of altering the depth of the depressions 6 and, therefore, the volume of the depressions by increasing or reducing the ambient pressure Pa, for example, by accommodating the screen or halftone roller 1 according to the invention within a non-illustrated housing which belongs to the inking unit, is sealed and has pressure applied thereto.

We claim:

1. A meterable screen roller, comprising:

a roller base member;

a resilient material located on said roller base member, said resilient material having an outer circumferential surface formed with depressions therein, said depressions having volumes; and chambers located underneath said depressions and assigned to said depressions;

said chambers at least partially formed in a component selected from the group consisting of said roller base member and said resilient material;

said chambers being actable upon by a pressure medium for respectively enlarging and reducing the volumes of said depressions.

2. The screen roller according to claim 1, comprising:

a structured tube that is located on said roller base member and that includes said resilient material;

said tube having an inner circumferential surface formed with webs disposed between said depressions;

said webs defining said chambers.

3. The screen roller according to claim 2, wherein said structured tube is slidable on said roller base member and said roller base member is rotatably mounted.

4. The screen roller according to claim 1, wherein:

said roller base member has a circumferential surface that is formed with recesses therein;

said recesses cooperate with said resilient material to form said chambers;

said roller base member is formed with feed ducts for applying the pressure medium to said chambers.

5. The screen roller according to claim 4, wherein said recesses are formed as a spirally revolving groove.

6. The screen roller according to claim 4, wherein said recesses are formed by grooves extending in axial direction over said circumferential surface of said roller base member.

7. The screen roller according to claim 4, wherein said roller base member, in the region of said outer circumferential surface thereof, is made of porous material connected to said pressure-medium feed ducts and formed with said recesses.

8. The screen roller according to claim 7, wherein said roller base member includes a rotatably mounted core and a jacket member made of said porous material disposed thereon, said recesses being formed directly in said jacket member.

9. The screen roller according to claim 4, comprising a sleeve slidable axially onto said roller base member; said sleeve including said resilient material.

10. The screen roller according to claim 9, wherein the depressions are formed in said sleeve as a permanently predefined structure.

11. In combination with the screen roller according to claim 4, a source of a liquid serving as the pressure medium.

12. A combination of:

the screen roller according to claim 4; and a source of a gas serving as the pressure medium;

a respective increase and decrease in a pressure of the gas serving to enlarge and reduce the volumes of the depressions.

13. The screen roller according to claim 1 being for an anilox inking unit in a rotary printing machine.

* * * * *